United States Patent [19]

Gleason

[11] Patent Number: 4,715,603

[45] Date of Patent: Dec. 29, 1987

[54] MINIATURE SIMULATED BASEBALL

[76] Inventor: Lawrence C. Gleason, 2036 Canyon #34A, Boulder, Colo. 80302

[21] Appl. No.: 906,229

[22] Filed: Sep. 11, 1986

Related U.S. Application Data

[63] Continuation of Ser. No. 740,954, Jun. 3, 1985, abandoned.

[51] Int. Cl.[4] ..... A63F 7/20

[52] U.S. Cl. ..... 273/90

[58] Field of Search ..... 273/88, 90, 87 C, 381, 273/26 A, 94

[56] References Cited

U.S. PATENT DOCUMENTS

| | | | |
|---|---|---|---|
| 268,895 | 12/1882 | Hoar | 273/381 |
| 951,257 | 3/1910 | Peuser | 273/89 |
| 1,096,362 | 5/1914 | Forbes | 273/90 |
| 1,147,087 | 7/1915 | Groh | 273/89 |
| 1,551,216 | 8/1925 | Potter | 273/89 |
| 1,573,182 | 2/1926 | Matha | 273/89 |
| 1,591,095 | 7/1926 | Meyer | 273/87 C X |
| 1,685,428 | 9/1928 | Lowry | 273/89 |
| 2,180,439 | 11/1939 | Stearns | 273/89 |
| 2,462,170 | 2/1949 | Dube | 273/90 |
| 2,672,343 | 3/1954 | Augier | 273/90 |
| 2,694,574 | 11/1954 | Baker | 273/89 |
| 2,802,667 | 8/1957 | Bertley | 273/89 |
| 2,980,427 | 4/1961 | Gragg | 273/90 |
| 3,009,452 | 11/1961 | Barber et al. | 273/89 X |
| 3,312,471 | 4/1967 | Nissen | 273/381 X |
| 3,381,961 | 5/1968 | Wright | 273/90 |
| 3,534,962 | 10/1970 | Singleman | 273/90 |
| 3,830,497 | 8/1974 | Peterson | 273/89 |
| 3,854,720 | 12/1974 | Duval | 273/89 |
| 4,017,074 | 4/1977 | Roberts | 273/89 |
| 4,210,326 | 7/1980 | Booth et al. | 273/26 A |

*Primary Examiner*—Paul E. Shapiro

*Attorney, Agent, or Firm*—Donald W. Margolis

[57] ABSTRACT

A miniature simulated baseball game utilizing an air pitched and batted ball on a board with natural component playing surfaces including artificial grass, raised canvas bases and a simulated dirt infield. The ball used in this game is light in weight and may be altered prior to play. When pitched through the air, a hard slider, riding fastball or change up is easily simulated. A pitching rubber allows a pitcher to get loft or arc on a pitched ball. Batting the air pitched ball produces an unexpected variety of basehits and plays usually limited to the conventional game of baseball. A padded recessed battersbox enables a batter to hit the air pitched ball. An audible strike indicator in an adjustable strike zone addes to the spontaneity of this game. The game has three dimentional baserunners in different poses to simulate breaking on the pitch and leading and tagging and defensive fielders. Miniature light towers gives players the opportunity to play a simulated night baseball game. This game includes a reversible pitching lane wherein younger less experienced players may play a simulated air pitched and batted ballgame. The range of skill and ability is from sandlot to professional baseball and the game is fun to play.

19 Claims, 15 Drawing Figures

MINIATURE SIMULATED BASEBALL

This is a continuation of application Ser. No. 740,954, filed June 3, 1985, now abandoned.

FIELD OF THE INVENTION

This invention relates to miniature baseball games and specifically to an improved method of play utilizing an air pitched and batted ball on a board with natural component playing surfaces.

DISCUSSION OF PRIOR ART

Heretofore, in previous games of this nature a ball or disc was propelled or rolled across a smooth surface to be struck with a bat. A round ball or marble was used but would not readily settle on a smooth surface. Various discs usually solid wood or plastic have been used to represent a ball but were heavy and generally confined to the playing surface. Batting and pitching mechanisms were often employed. Fixed scoring zones on both the infield diamond and outfield have been frequently shown. Players have been represented as chips, pegs, bumpers and markers and model players have been attached to ball trapping devices. Strike zones in previously simulated baseball games of this nature have been shown as depressions in the playing surface behind homeplate, and pegs through which a ball rolled must pass to be a strike. Strikezones in previous games have usually been confined to a fixed opening with the bottom of said opening adjacent to the playing surface.

The pitching and batting, the ball, the strikezone and playing surface in previous games have not been completely representive of the conventional game of baseball.

This game is distinguished from previous simulated baseball games by means of an air pitched and batted ball and by a simulated natural component playing surface.

OBJECTS OF THE INVENTION

Accordingly several objects of my invention are to provide a miniature baseball game utilizing an audible strike indicator in an adjustable strikezone.

An object of the invention is to provide an improved light weight ball which closely simulates the ball used in an actual game of baseball.

A further object of the invention is to provide a reversible pitching lane with artificial grass on the (A) side where on players develop their own abilities and strategy with an air pitched and batted ball. A second pitching lane made to simulate the appearance of grass, for example, in the form of a semi-smooth plywood strip with the grain running perpendicular to the length of said pitching lane on the (B) side, to accomadate younger inexperienced players in the playing of a simulated air pitched ball game. That is to say, said pitching lane (B) is a simulation of said pitching lane (A).

A further object of the invention is to provide a recessed battersbox wherein the batter is better able to bat the air pitched ball.

Another object of the invention is to provide predetermined openings on either side of homeplate to limit a batters swing on both horizontal and vertical directions.

A further object of the invention is to provide a plurality of three simulated lifelike baserunners with means for stealing bases.

A further object of the invention is to provide a new and improved game simple in construction, economical to build and fun to play.

Further objects and advantages of my invention will become apparent from a consideration of the drawings and ensuing description thereof.

A BRIEF DESCRIPTION OF THE DRAWINGS

Figure 8:
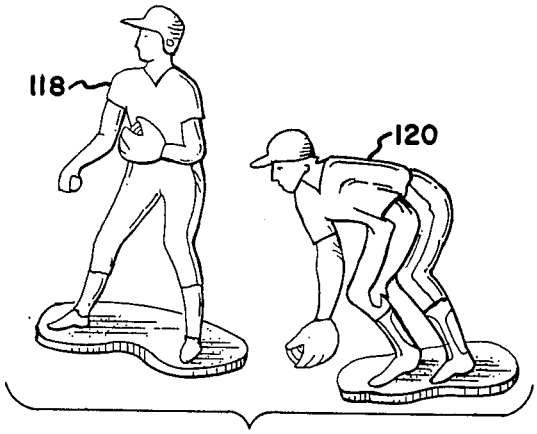
Figure 9:
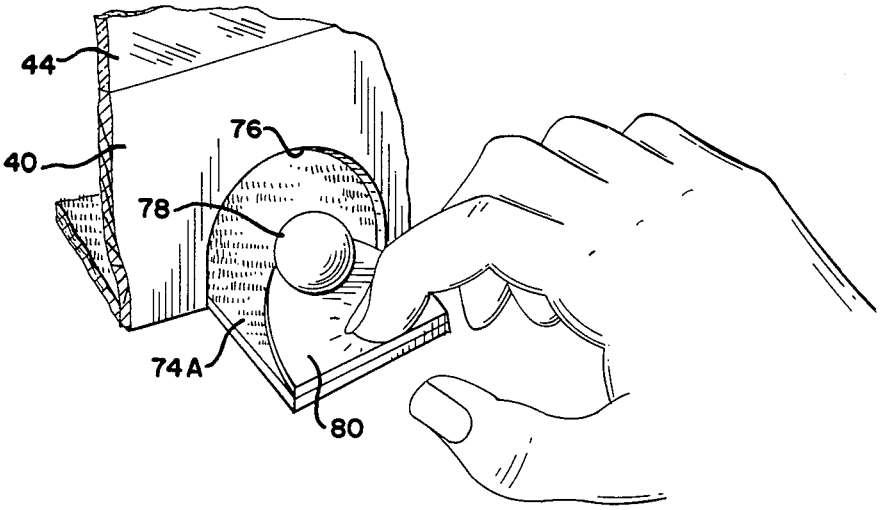
Figure 10:
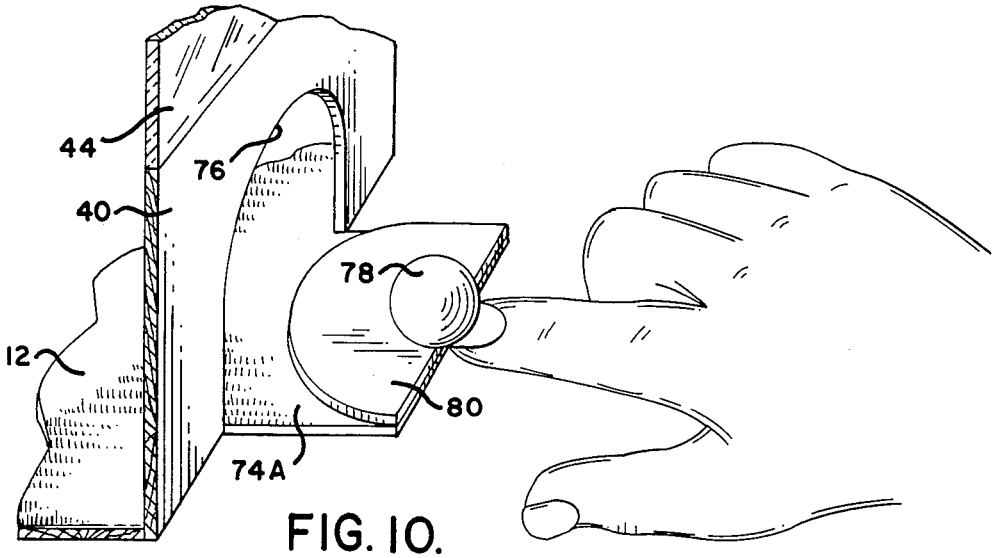
Figure 11:
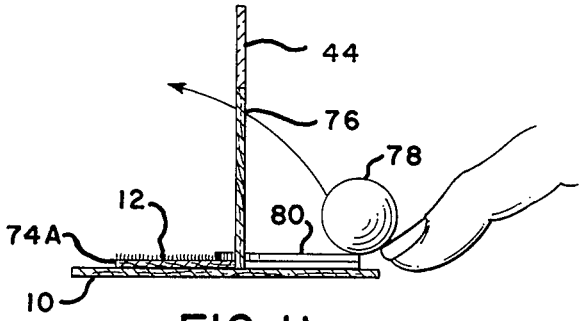
Figure 12:
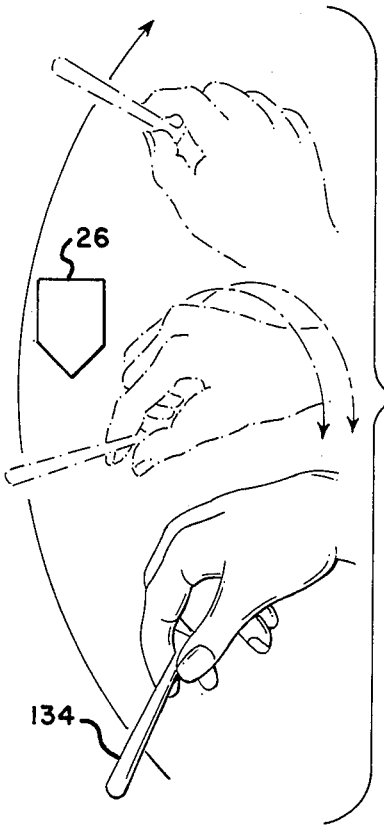
Figure 13:
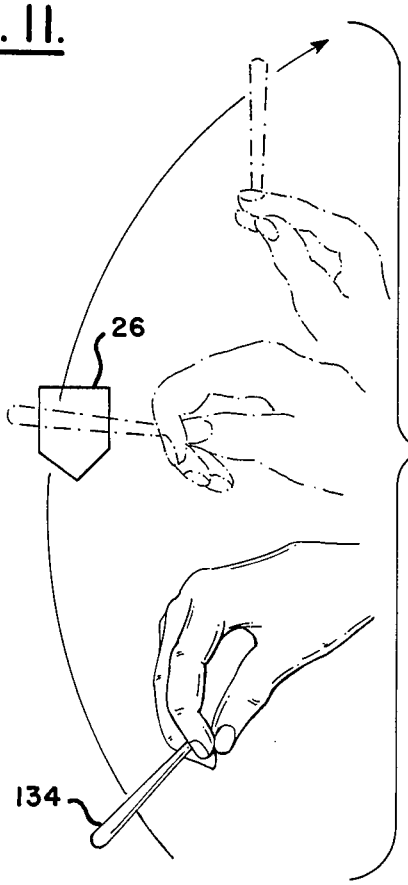
Figure 14:
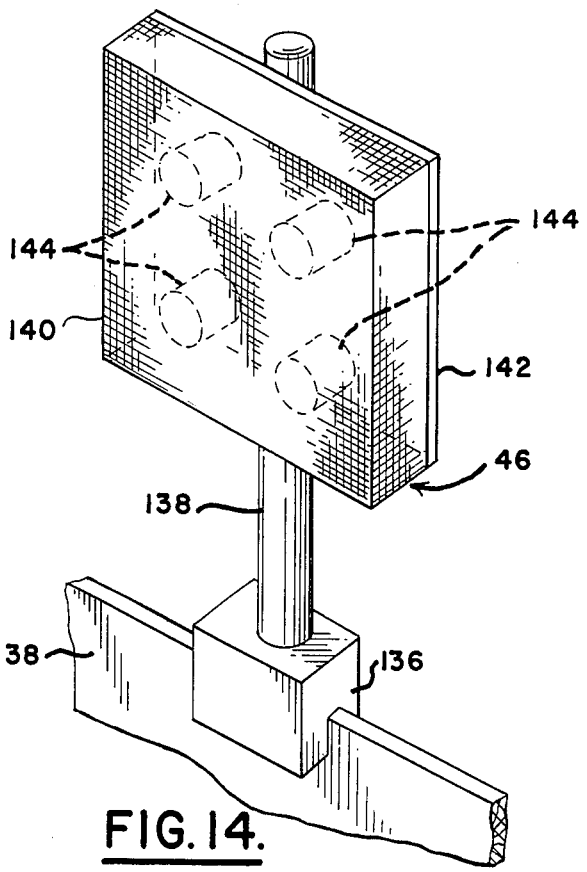
Figure 15:
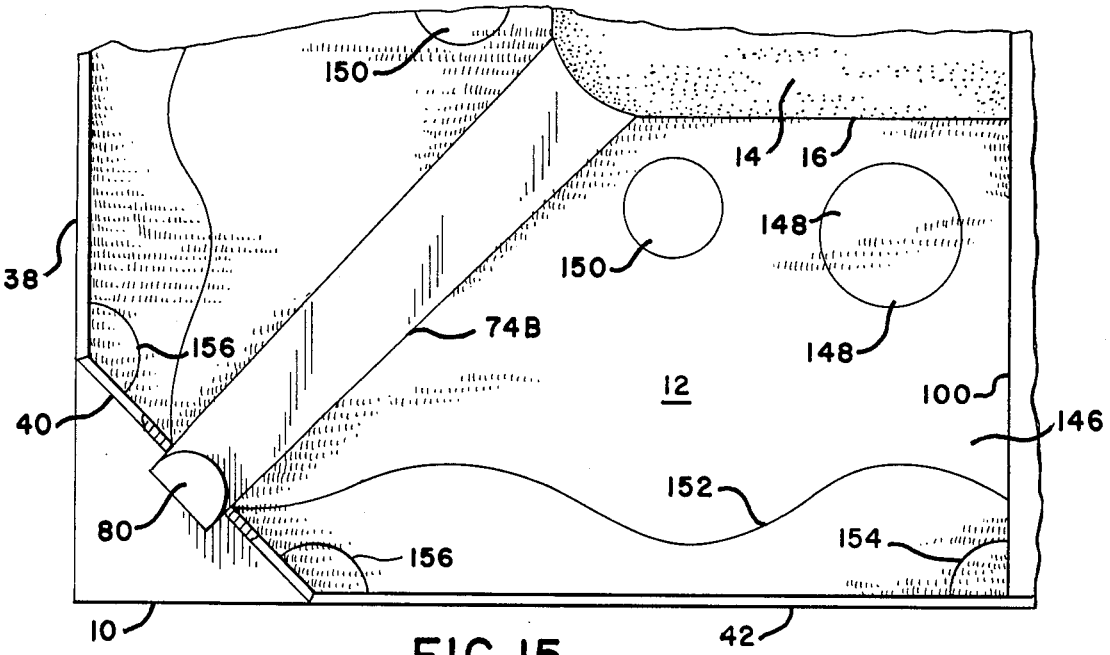

FIG. 8. is a view of the defensive fielders used in the game;

FIG. 9, is a view of the pitching means used in the game, and a pitching technique;

FIGS. 10, 11, are views of pitching techniques used in the game;

FIGS. 12, 13, are views of the batting techniques used in the game;

FIG. 14, is a view of the lighting system used in the game;

FIG. 15, is a partial view of the optional defensive layout as used in the game.

DESCRIPTION OF THE PREFERRED EMBODIMENT

Figure 1:
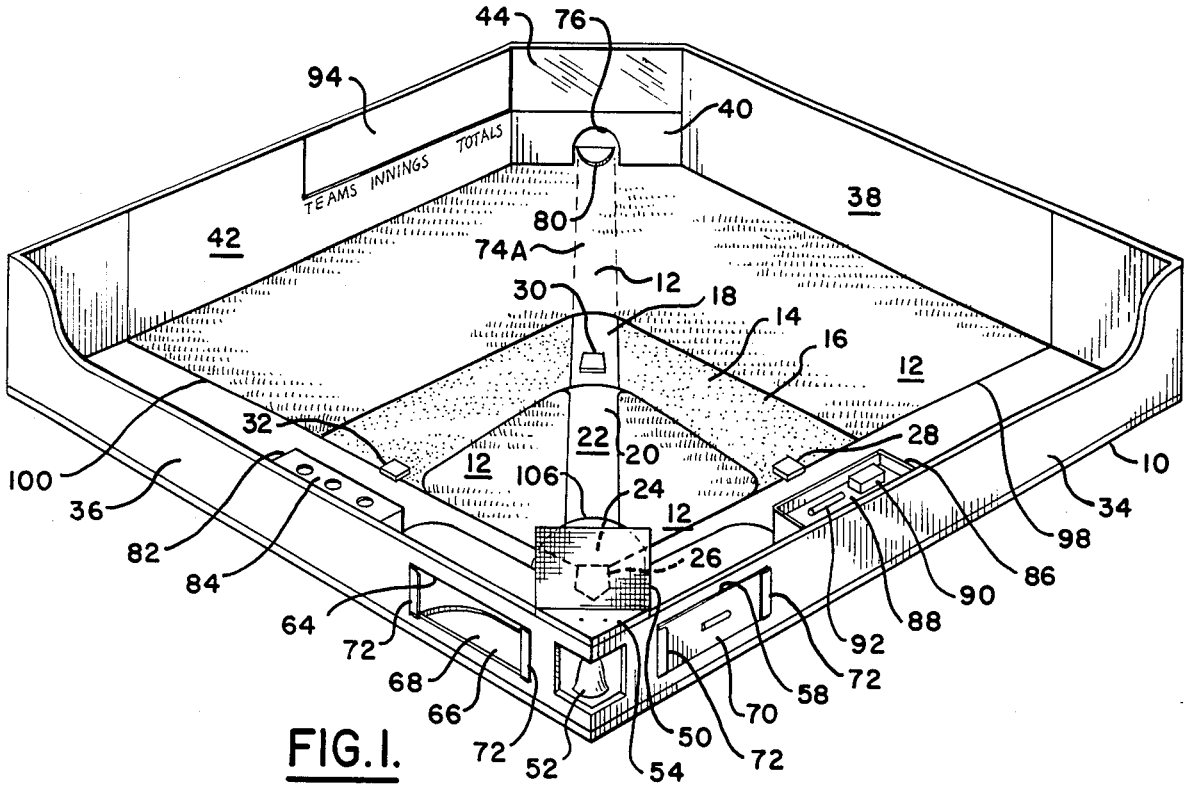
FIG. 1, is a perspective of the miniature baseball game forming this invention.

Referring now to FIG. 1, the miniature baseball game herein is made up of a bottom structure 10, natural component playing surfaces; artificial grass 12 bonded by glue to the bottom structure 10, finely crushed ore 14 bonded by glue to an infield diamond 16, said infield diamond is bonded by glue to bottom structure 10. Infield diamond 16 is a semi-smooth plywood board and with a coating of finely crushed ore 14, said infield diamond has a playing surface 1/16" of an inch lower than artificial grass 12 thereby simulating quite closely a corresponding height relationship between dirt and grass as found in the conventional game of baseball. An exposed wood area of said infield diamond is section 18 with markings thereon; infield error 20, pitchers play 22, catchers play 24 and homeplate 26 and extends from the centerfield edge of said infield diamond to the homeplate 26 area. Infield diamond 16 is further enhanced with artificial grass 12 bonded to bottom structure 10 with glue in the infield areas where grass is found corresponding to areas of infield grass as found in the regulation game of baseball.

Three raised canvas bases; a firstbase 28, a second base 30 and a thirdbase 32 are bonded to infield diamond 16 by glue.

There are five boarder walls, said walls being a firstbase wall 34, a thirdbase wall 36, a right field wall 38, a centerfield wall 40 and a leftfield wall 42. The centerfield wall 40 has a Plexiglas TM pitching window 44 therein.

Light towers 46 and 48 can be mounted atop walls 38 and 42, for the simulation of night baseball games (FIG. 14).

Figure 3:
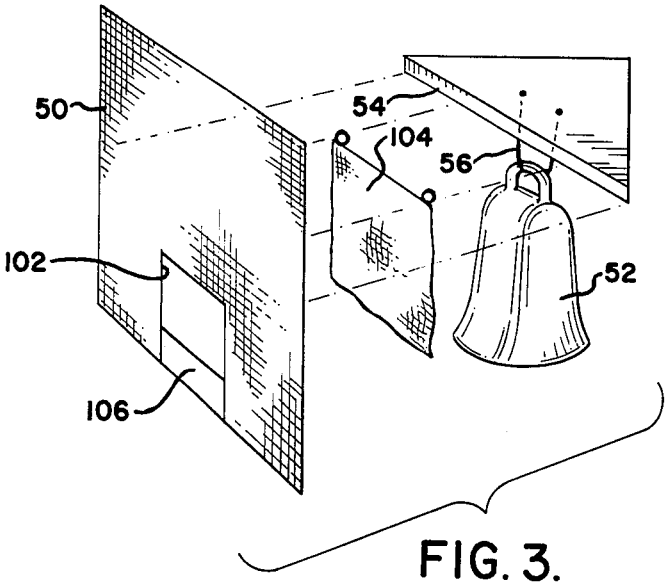
FIG. 3, is an exploded view of the elements comprising the adjustable strikezone.

A backstop 50 extends between walls 34 and 36 and said backstop should be higher than said walls. A plastic or wire mesh is suitable for said backstop with the mesh having ⅛" to ¼" openings therein. An audible strike indicator 52 is suspended from a horizontal triangular surface 54 by wire 56, between the back of said backstop and the apex of walls 34 and 36 (FIG. 3). A small copper cow bell is the audible strike indicator 52.

In wall 34 is a predetermined opening 58 where in a batter may place his batting hand in the battersbox 60 to bat from the firstbase side of the field. The said battersbox is recessed with a padded handrest 62 glued therein to bottom structure 10. Vinyl or leather is suitable for handrest 62. In wall 36 is a predetermined opening 64 wherein a batter may place his batting hand in the battersbox 66 to bat from the thirdbase side of the field. The said battersbox is recessed with a padded handrest 68 glued to bottom structure 10.

A small door 70 seals the opening opposite the batter. That is to say when a batter places his batting hand through opening 58 to bat from battersbox 60 on the firstbase side of the field, small door 70 seals opening 64 on the thirdbase side of the field by sliding in place between wall 36 and guides 72. The function of small door 70 is to keep foul balls on the field.

Figure 4:
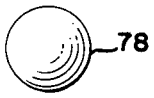
FIGS. 4, 5, are views of the ball used in the game.
Figure 5:
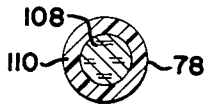

A reversible pitching lane 74A, extends from one inch outside the centerfield wall 40 to infield surface 18. An opening 76 in the base of the centerfield wall 40 through which said pitching lane passes, restricts the amount of loft or arc a pitcher may put on an air pitched ball 78 (FIGS. 4, 5). The playing surface of pitching lane 74A is 12.

A pitching means 80 made of a soft flexible material of a thickness easily depressed with a finger tip, is mounted on said pitching lane and secured there on by glue, at the centerfield end of said pitching lane. A variety of materials may be used for said pitching means such as a soft rubber, cork, or vinyl (FIG. 9).

A simulated dugout 82 glued to bottom structure 10 and wall 36 on the thirdbase side of the field functions as a batrack 84. A simulated dugout 86 glued to bottom structure 10 and wall 34 on the firstbase side of the field functions as a tray 88 containing an eraser 90 and chaulk 92. A slate blackboard 94 is painted on wall 42 and functions as a scoreboard. Homeplate 26, first base foul line 96, and thirdbase foul line 98 comprise the area of fair ground.

Figure 2:
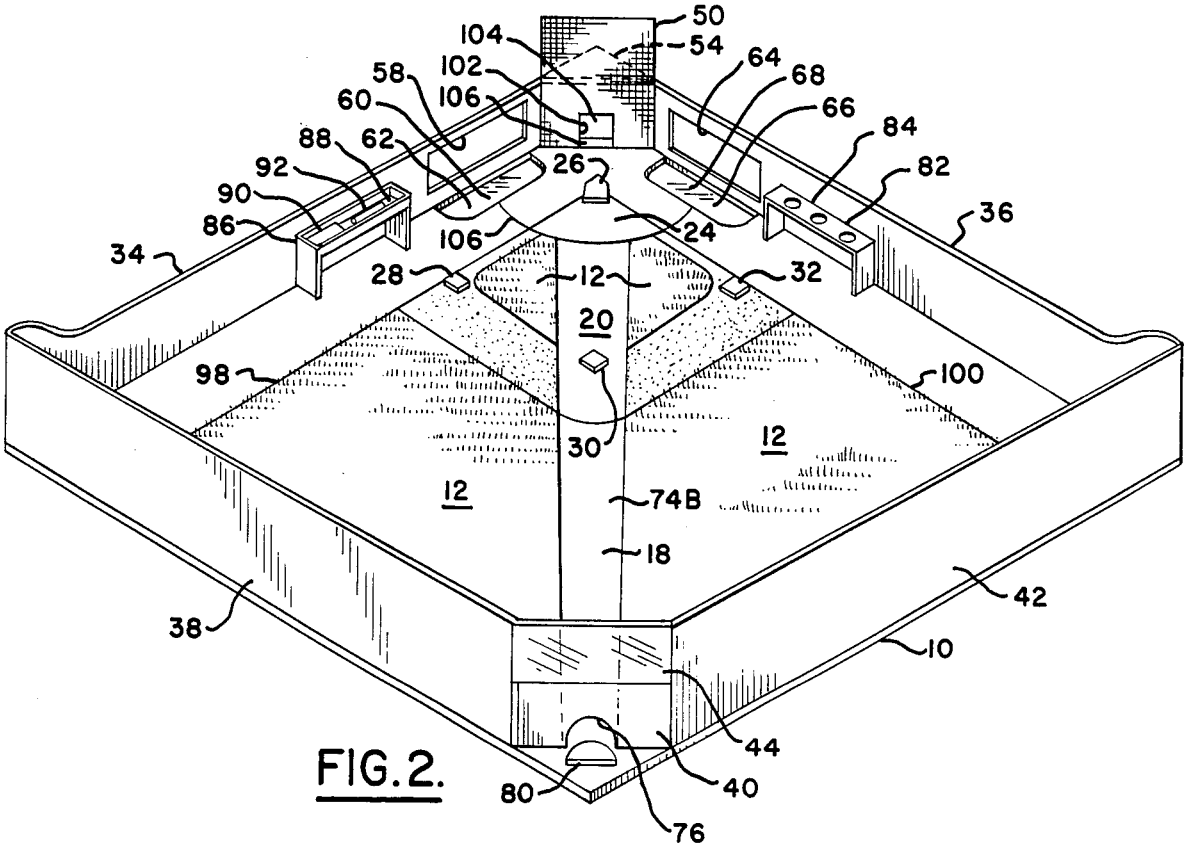
FIG. 2, is a perspective of said game with the pitching lane reversed.

Referring now to FIG. 2, there is shown pitching lane 74B. The playing surface 18 of said pitching lane is a semismooth plywood strip with the grain of the wood running perpendicular to the length of said pitching lane. Pitching lane 74B is a simulation of pitching lane 74A. A front view of backstop 50 is shown with opening 100 and catcher curtain 104 (FIG. 3).

Referring now to FIG. 3, there is shown an exploded view of the elements that comprise the adjustable strikezone. The catcher curtain 102 hangs in predetermined opening 100. behind said opening the audible strike indicator 52 is suspendedby wire 56 from surface 54, a barrier 106 which is removable, constitutes the adjustable element of said strikezone.

Referring now to FIGS. 4, 5, there is shown the ball 78 as used in the game. The center or core 108 of said ball is made of cork. Other air trapping materials will work as said core, for example, soft rubber, Styrofoam, TM or sponge. The exterior 110 of said ball is moulded from FRIENDLY PLASTIC compound. This plastic melts at a temperature of 135° F. and may be shaped with barehands. By immersing a section of ball 78 in hot water for 15 seconds said section softens and a flat spot may be applied to said soft section. Ball 78 now altered, when pitched through the air will tend to dip or sink and has the effect of a regulation 'hardslider'. Ball 78 could also have raised simulated stiches sculpted in the exterior plastic shell 110, said stiches would be means for said ball to do unexpected and novel things when pitched through the air.

Figure 6:
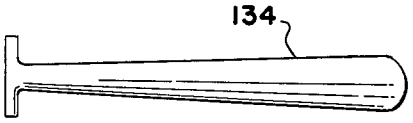
FIG. 6, is a view of the bat used in the game.

Referring now to FIG. 6, is a view of the bat 134 used in the game, said bat is fashioned from white ash. Other hardwood such as beech, maple and oak are suitable for said bat.

Figure 7:
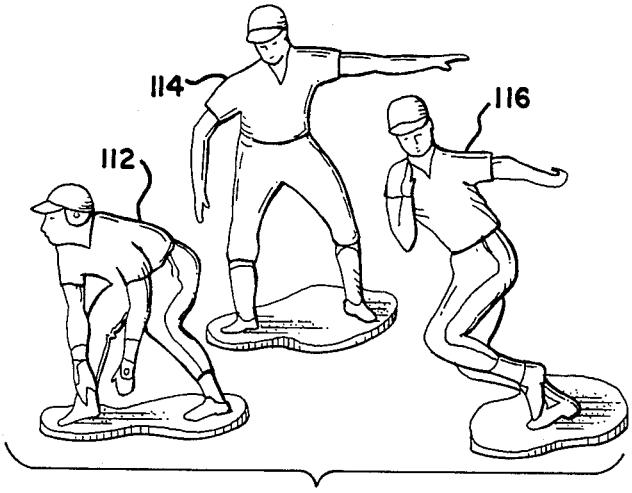
FIG. 7, is a view of the baserunners used in the game.

Referring now to FIG. 7, there is shown a plurality of three baserunners being designated as, a tagging baserunner 112, a leading baserunner 114, and a breaking baserunner 116. A hard substance such as plastic or wood is suitable material from which said baserunners may be sculpted as three dimentional figures, hand painted, mounted on flat sturdy baseplates.

Referring now to FIG. 8, there is shown a representative view of two of the defensive fielders used in the game, pitcher 118 and first baseman 120. Other defensive fielders used in the game are second baseman, shortstop, third baseman, left fielder, centerfielder, and right fielder.

Referring again to FIG. 9, ball 78 is shown on the leading edge of pitching means 80, a finger behind said ball presses down on the rubber, enabling the pitcher to get under the said ball and thereby loft or arc said ball toward the strike zone.

Referring now to FIGS. 10, 11, therein is shown a pitching technique wherein ball 78 is placed at the outer end of pitching lane 74A on pitching means 80. A finger is placed beneath a section of ball 78 which extends beyond the end of said pitching means and when flicked by said finger ball 78 is pitched on an arc toward the strikezone, passing through opening 78 in wall 40.

Referring now to FIG. 12, there is shown a technique for batting ball 78 with bat 134 using the 'wrist' method wherein the said wrist is rotated to bring bat 134 in line with ball 78. There is slight scooping action with this batting technique.

Referring now to FIG. 13, there is shown a technique for batting ball 78 with bat 134 using the 'back flip' method wherein ball 78 is batted with a backhand motion and the thumb is pressing firmly against the heel of said bat.

Referring now to FIG. 14, there is shown a view of the light tower 46 used in the game. Said light tower being comprised of a slotted basemember 136, a shaft 138, a screen enclosure 140 and a backplate 142, said components are glued together and house four lamps 144. A type of blub suitable for use, for example, could be a G.E. all-glass wedge base miniature lamp designed for circuits of under 12 volts, said lamp having a 10 mm diameter. A power source is not shown as there are many readily available.

Referring now to FIG. 15, there is shown a partial view of an optional defensive layout 146, said optional defensive layout may be applied to artificial grass 12 with chaulk 92 and is easily removed by brushing. Circle 148 designates a double, circle 150 an outfield error, serpentine line 152 is a double for a ball batted which settles between said line and outfield wall 42. A ball batted which settles in quarter circles 154 and 156 is scored as a triple. Optional defensive layout 146 is suggested for younger players in combination with pitching lane 74B.

OPERATION OF INVENTION

Prior to play opponents may agree on 'ground rules', for example, the number of innings to be played, the use of a round or altered ball 78, pitching lane 74A or 74B, the size of the adjustable strikezone with barrier 106, and the optional defensive layout 146, if desired.

An opponent pitcher places ball 78 on the pitching means 80. An object of said opponent pitcher is to 'throw' strikes. By pressing down on said pitching means 80 with a finger tip behind ball 78 said opponent pitcher is able to get 'under' said ball and thereby lift said ball into the air with a flick of said fingertip. Opening 76 in wall 40 functions as a restriction, limiting the amount of loft or arc said opponent pitcher is able to put on ball 78.

Ball 78 is pitched through the air, passed the waiting opponent batter and into the strikezone thereby ringing the audible strike indicator 52 for a strike. Of course a ball pitched that results in a swinging strike need not actuate said audible strike indicator. However said opponent pitcher with ordinary skill in the practice will often get 'called' strikes. That is to say when pitched ball 78 enters the strikezone and rings said audible strike indicator, whether swung at or not by an opponent batter, said pitched ball is a strike. Another object of said opponent pitcher is to confuse said opponent batter by using a variety of 'pitches', for example, said opponent pitcher may elect to pitch 'a riding fastball'. That is to say ball 78 pitched, which starts out low at pitching means 80 and rises to the top of the strikezone. Another effective pitch available to said opponent pitcher is a 'hard slider'. That is to say ball 78 pitched which leaves the pitching means 80 high and then dips sharply to the bottom of the strikezone.

A variety of pitches found in the conventional game of baseball can be simulated from pitching means 80. A change up, blooper, said riding fastball, and knuckleball are easily learned. When ball 78 is altered with a flat spot, the type of pitch thrown will depend on the angle in which said flat spot is positioned prior to the pitch. For example, with said flat spot facing in the direction of homeplate 96 as ball 78 is pitched, said flat spot will 'catch air' and said ball will dip sharply into the lower portion of the strikezone.

A further enhancement of pitching ability can be created by said opponent pitcher's defensive alignment. For example, said opponent batter is batting from the thirdbase side of the battersbox 66. By positioning defensive infielders; pitcher 118, first baseman 120, second baseman on the first base side of the diamond 16 and by shifting left fielder centerfielder and right fielder to said opponent pitcher's left, a defense is set. By pitching fastballs on the outside corner of homeplate 26 said opponent pitcher hopes to induce said opponent batter to 'hit' into the heart of said defense, knowing the tendency is to swing 'late' on fastballs.

Ball 78 may be pitched from any part of the surface of the pitching means 80.

An opponent batter assumes a batting position in battersbox 66 on the thirdbase side of the field by placing his batting hand through opening 64 in wall 36 and by placing said batting hand on padded vinyl handrest 68.

An object of said opponent batter is to bat the air pitched ball 78 thereby getting basehits and scoring runs. As in the actual game of baseball, the batting of said airpitched ball will produce an unexpected variety of the types of 'hits' made in the conventional game. Ball 78 batted may be popped high in the air, chopped into the dirt and hit on a 'line', as with good wood on said ball. The horizontal and vertical restrictions imposed on said opponent batter's swing by opening 64 and line 106 painted on playing surface 18 Will limit said opponent batters intrusion onto the playing field and will keep opponent batter's swing confined to a wrist action. It is this short, swift compact swing wherein said opponent batter is best able to bat the said air pitched ball.

A further enhancement of batting ability can be created by said opponent batter's use of baserunners: a tagging baserunner 112, a leading baserunner 114, and a breaking baserunner 116. The choice of said baserunners adds spontaneity to this miniature simulated baseball game as it does in the regulation game of baseball. For example, from first base; a breaking baserunner 116 advances three bases and scores on an out field single, a leading baserunner 114 advances two bases on said single to the outfield, a tagging baserunner 112 advances one base on said single to the out field.

The following rules may be applied to the apparatus to best provide a simulation of the pitching and batting and base runniing found in the actual game of baseball and simulation of the plays as they occur on natural component playing surfaces with the aid of an air pitched and batted ball.

ERROR 20

A ball batted into the area marked ERROR is a PITCHERS PLAY unless the ball first touches a defensive player before settling.

EXAMPLE: The bases are loaded and there are two outs. The ball batted makes contact with the shortstop, and settles in the area marked ERROR.

RESULT: The bases are still loaded there are two outs and a run has scored. Baserunners 112 and 114 advance one base, and baserunner 116 advances two bases.

PITCHERS PLAY 22

A ball batted, chopped or accidentally batted into the area marked PITCHERS PLAY is an out at first base.

EXAMPLE: There is a tagging baserunner 112 at third base and one out. The batter bats the ball into the area marked PITCHERS PLAY.

RESULT: The pitcher throws out the batter at first base, there is a baserunner at third base, there are two outs and no runs have socred. Baserunner 114, same result, Baserunner 116 scores on the play.

CATCHERS PLAY 24

A ball bunted, chopped or accidentally batted into CATCHERS PLAY is an out at first base. If there are baserunners and less than two outs the catcher forces out a breaking baserunner 116.

EXAMPLE: The bases are loaded and there is one out. The batter attempting to bunt for an infield hit bats the ball into the area marked CATCHERS PLAY.

RESULT: The catcher will make an unassisted play at home. The bases are still loaded, there are two outs and no runs have scored. Baserunners 112, and 114 same result.

Because of the unique artificial grass 12 playing surface, scoring zone markings are not necessary in the out field grass area. Outs can be made when a ball batted strikes a defensive outfielder, or, on the fly and is rules a catch and an out. A double play could result on an out field catch if leading baserunner 114 or breaking baserunner 116 were on base with less than two outs. A tagging baserunner 112 would advance one base on the play. A ball batted which settles in front of said defensive outfielder's is a single, a ball batted which settles behind said defensive outfielders is a double and a ball batted which settles against the out field wall is a triple. A ball batted which settles outside the park, having cleared a wall over fairground is a homerun.

While the above description contains many specificities, these should not be construed as limitations on the scope of the invention, but rather as an exemplification of one preferred embodiment thereof. Many other variations are possible, for example baserunners could be mounted on a monorail or track which in turn could be secured to bottom structure 10 and by mechanical means be made to move simaltainously with a ball pitched creating a hit and run situation. Defensive infielders, by means stated above, could be made to move left to right and the reverse to intercept the anticipated flight of a ball batted, thereby creating a shifting defense. Defensive outfielders could be mounted to a circular monorail or track and by means stated above, could be made to 'come in' toward the infield or 'go back' toward the wall to intercept the actual flight of a ball batted, thereby creating a 'field of range'.

Another variation that is possible, for example, is to add adjustable means to opening 76, allowing less loft or arc restriction wherein a simulated slow pitch softball game could be played.

Having described the invention and the mode of its practice what I distinctly claim and particularly point out as new and desire to secure by Letters Patent of the United States is:

1. The baseball game with a lighting system to simulate an actual night baseball game said lighting system comprising:

(1) a slotted base member with said slot having a width wide enough to fit snugly on top of a boarder wall;

(2) a shaft whereby said base member is connected to a backplate; and (3) a plurality of miniature lamps set in said backplate; and (4) a screen connected to said backplate encasing said lamps whereby said lamps are protected from damage by a ball batted.

2. A miniature simulated baseball game using a miniature simulated baseball, a plurality of simulated baserunners, and a plurality of simulated miniature defensive fielders which comprises:

(A) a component playing surface simulating quite closely an actual baseball playing field, including a home plate, an infield diamond, and an outfield;

(B) an adjustable simulated strike zone comprising;

(1) a backstop located behind home plate, said backstop having an adjustable opening; and (2) a barrier means for adjusting the size of said adjustable opening to thereby define said strike zone;

(C) a means to pitch a simulated miniature baseball, said baseball pitching means spaced from said simulated home plate and including a soft flexible material of a thickness easily depressed by a finger tip; and (D) a right and a left battersbox, said battersboxes being adjacent said home plate and including means for resting a hand therein.

3. The simulated baseball game of claim 2 wherein said pitching means allows a miniature simulated baseball to be rolled or lofted, and wherein a restriction means that will limit the loft of a miniature simulated baseball is included.

4. The simulated baseball game of claim 2 wherein a means to indicate a pitched strike is located behind said opening in said backstop.

5. The simulated baseball game of claim 4 wherein said means to indicate a pitched strike provides an audible indication.

6. The simulated baseball game of claim 5 wherein said audible means to indicate a pitched strike includes a bell.

7. The simulated baseball game of claim 2 wherein a means to indicate a pitched strike is located behind said opening in said backstop, and wherein further said means to indicate a pitched strike is a small cow bell.

8. The simulated baseball game of claim 2 wherein artificial grass and simulated dirt or gravel are utilized to simulate a baseball playing field on said component playing surface.

9. The simulated baseball game of claim 2 wherein there is a pitching lane intermediate said baseball pitching means and said simulated home plate.

10. The simulated baseball game of claim 9 wherein said pitching lane is a removable and reversible two sided strip.

11. The simulated baseball game of claim 10 wherein said reversible strip constituting said pitching lane carries artificial grass on one side.

12. The simulated baseball of claim 10 wherein said reversible strip constituting said pitching lane carries artificial grass on one side and simulated grass on the other side.

13. The simulated baseball game of claim 2 wherein there is a wall substantially surrounding said component playing surface.

14. The simulated baseball game of claim 13 wherein there are predetermined openings in said wall adjacent to said right and left battersboxes for inserting a hand.

15. The simulated baseball game of claim 13 wherein said pitching means allows a miniature simulated baseball to be rolled or lofted, said pitching means being located outside of said wall, and wherein further there is a predetermined opening in said wall adjacent to said pitching means to allow the passage of a miniature simulated baseball.

16. The simulated baseball game of claim 15 wherein said opening in said wall adjacent to said pitching means includes means for restricting the loft of a pitched miniature simulated baseball.

17. The simulated baseball game of claim 2 wherein said pitching means is made of resilient, flexible material.

18. The simulated baseball game of claim 17 wherein said resilient flexible pitching means is rubber.

19. The simulated baseball game of claim 2 wherein said hand rest means includes a depression in said component playing surface.

* * * * *